US005607067A

United States Patent [19]

Morrissey

[11] Patent Number: 5,607,067

[45] Date of Patent: Mar. 4, 1997

[54] DETACHABLE NOTEPAD HOLDER AND NOTEPAD SYSTEM

[75] Inventor: Thomas J. Morrissey, Greenwich, Conn.

[73] Assignee: Jot-That-Thought, Inc., Greenwich, Conn.

[21] Appl. No.: 401,923

[22] Filed: Mar. 9, 1995

[51] Int. Cl.[6] ..... A47F 5/00

[52] U.S. Cl. ..... 211/50; 211/45; 206/215; 206/449; 248/205.2; 248/206.5

[58] Field of Search ..... 211/50, 89, 45; 206/215, 449; 248/316.7, 205.2, 206.5

[56] References Cited

U.S. PATENT DOCUMENTS

| | | | |
|---|---|---|---|
| 4,420,112 | 12/1983 | Cline | 206/215 X |
| 4,610,054 | 9/1986 | Malian | 248/205.2 X |
| 4,696,399 | 9/1987 | Windorski | 206/215 X |
| 4,998,704 | 3/1991 | Tarlow et al. | 248/206.5 X |
| 5,050,830 | 9/1991 | Hall | 248/205.2 |
| 5,145,140 | 9/1992 | Caston et al. | 248/205.2 X |
| 5,427,254 | 6/1995 | Knieriem | 248/205.2 X |
| 5,480,037 | 1/1996 | Pope | 211/50 |

*Primary Examiner*—Robert W. Gibson, Jr.

[57] ABSTRACT

A notepad system for releasable attachment to a surface such as the visor of a car is disclosed and comprises a notepad and a notepad holder. The notepad has a backing sheet supporting a plurality of rectangular sheets of writing paper. The notepad holder comprises two rectangular support sheets having a high degree of rigidity adhered together in face-to-face relation to define a slot therebetween. The backing of the notepad is inserted into the slot, and the friction between the backing sheet and the rectangular support sheets retains the notepad and the notepad holder in an assembled condition. The notepad system may be releasably secured to a surface such as the visor of a car through the use of conventional hook and loop material.

12 Claims, 2 Drawing Sheets

DETACHABLE NOTEPAD HOLDER AND NOTEPAD SYSTEM

BACKGROUND OF THE INVENTION

1. Field of the Invention

The present invention relates to writing tablets kept in cars, trucks or on other surfaces such as a refrigerator and the like. More specifically, the present invention relates to a notepad holder and a notepad system for attachment to the visor of a car or truck.

2. Brief Description of the Prior Art

It is useful to have a notepad available when a businessman stops on the side of the road to make a telephone call or record notes. On occasion, a businessman will keep a conventional writing pad in the car in a location such as the glove compartment or the compartments in the side doors. This notepad may get lost or frayed and is difficult to utilize. More recently, a complex notepad holder has been developed that includes a suction cup attached to an arm which is in turn attached to a clipboard. The notepad holder is secured by the suction cup to a surface of the car, and the notepad is permanently available. The disadvantage with this type of notepad holder is that it is always visible and unsightly. Additionally, it is designed to stay in the car only. Further, if the notepad holder is accidentally bumped by a passenger, the suction cup will disengage and the holder will fall. Moreover, this type of notepad is not portable, that is, it is cumbersome to carry around and the suction cup may not easily attach to other surfaces.

SUMMARY OF THE INVENTION

Accordingly, it is an object of the present invention to provide a notepad holder and notepad system that permits the convenient storage of a notepad in a car or truck such that the notepad is not visible during storage.

It is a further object to provide a notepad system wherein the notepad is portable. More specifically, it would be desirable to be able to remove the notepad from the car, utilize it in a business office or elsewhere and then put it back in the car.

It is a further object of the present invention to secure the notepad holder in a fixed location so that when the user seeks to access the notepad, it is in a position where it can be readily located.

In accordance with one aspect of the invention, a detachable notepad holder and notepad system for attachment to a surface is disclosed. The notepad comprises a rectangular backing supporting a plurality of rectangular sheets of writing paper. The backing and the sheets have substantially identical width, and the sheets are bound to the backing along an edge of the backing. The height of the backing is preferably less than the height of the sheets.

The paper sheets are in face-to-face relation with the backing and define a slot between the innermost sheet of paper and the backing. The slot tapers inwardly as it approaches the bound edge.

A notepad holder is provided and comprises a first support sheet having a high degree of rigidity such as a sheet of pressboard or mat board. A second rectangular support sheet is provided and also has a high degree of rigidity, preferably made out of the same material as the first support sheet. The second support sheet has a height and width no larger than the height and width of the first support sheet. The first and second support sheets are located in face-to-face relation and are adhered, preferably by the use of an adhesive, along one edge thereof to define a slot between the support sheets.

The slot between the support sheets releasably receives the backing of the notepad, the backing being inserted into the slot and being retained in the slot by friction between the backing and at least one of the support sheets.

The notepad can be removed from the notepad holder by simply applying enough force to overcome the friction between the support sheets and the backing to remove the notepad. The empty notepad can then be replaced with a full notepad.

Preferably, the notepad holder is releasably attached to a surface such as the side of a car visor or the surface of a refrigerator. More specifically, a VELCRO attachment system may be used wherein a rectangle of hook material is attached to either the visor or refrigerator surface and a rectangle of loop material is attached to the back of the support sheet. The hooks can be mated with the loops to releasably secure the notepad system.

A notepad holder and notepad system in accordance with the present invention has the advantages that it is simple and inexpensive to fabricate, adequately holds the notepad in place, and can fit in the space between a car visor and the ceiling of the car. A moderate amount of force is necessary to remove the backing of the notepad from the slot between the two support sheets, and thus, the notepad and notepad holder are held in an assembled position by such friction. Once the writing sheets of the notepad are consumed, the notepad can be removed, and a new and full notepad is inserted.

The invention and its particular features and advantages will become more apparent from the following detailed description when considered with reference to the accompanying drawings.

BRIEF DESCRIPTION OF THE DRAWINGS

FIG. 5 shows a perspective view of the bottom on the notepad shown in FIG. 4;

FIG. 6 shows a perspective view of a hook material; and

FIG. 7 shows a sectional view of the notepad attached to a surface.

DETAILED DESCRIPTION OF THE DRAWINGS

Figure 1:
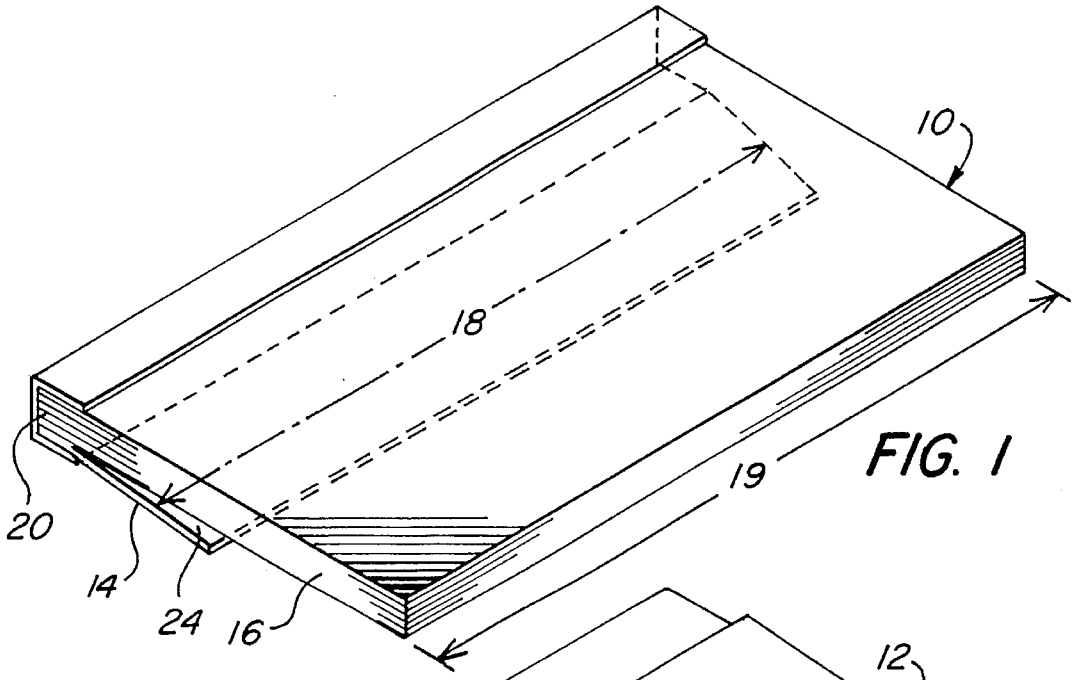
FIG. 1 is an perspective view of the notepad that is attached to the notepad holder shown in FIG. 2 constructed in accordance with the present invention.
Figure 2:
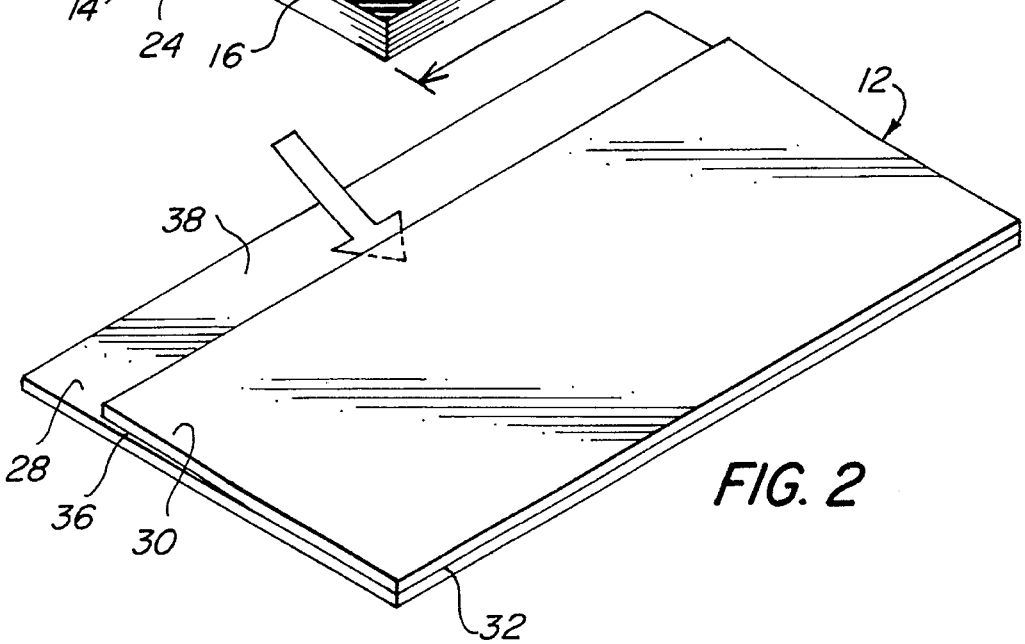
FIG. 2 is a perspective view of the notepad holder.
Figure 3:
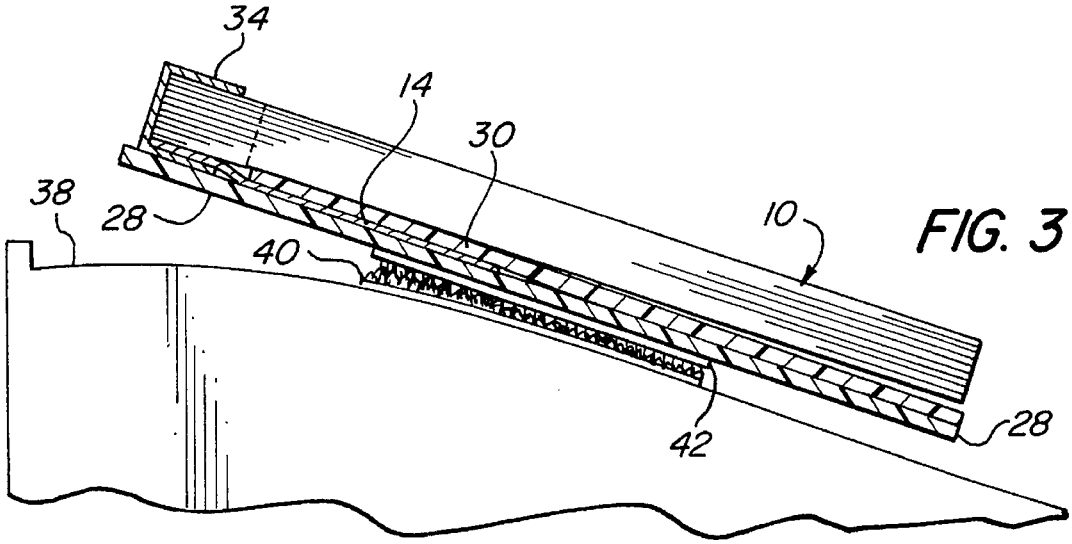
FIG. 3 is a sectional view of the notepad shown in FIG. 1 assembled with the notepad holder shown in FIG. 2 attached to a surface.

Referring to FIGS. 1–3, one embodiment of a detachable notepad system is shown. The detachable notepad system includes a notepad (10) and a notepad holder (12). The notepad (10) comprises a rectangular backing (14) supporting a plurality of rectangular sheets of writing paper (16). The backing is made from cardboard or other conventional material for backing a notepad. The backing (14) has a width (18) that is substantially identical to the width (19) of said sheets of paper (16). The sheets (16) are bound to the backing (14) along an edge (20) of the sheets. The sheets may be bound in any conventional manner, including a binding (22) that is either adhered, stitched, stapled or attached by some other means to the sheets (16) and the backing (14). The sheets of paper are in face-to-face relation with the backing (14) and define a slot (24), the slot (24) tapering inwardly as it approaches the bound edge (20). In a preferred form of the invention, the backing (14) has a height that is substantially less than the height of the sheets of paper (16).

Referring in particular to FIG. 2, a notepad holder (12) in accordance with the present invention will now be described. The notepad holder comprises a first support sheet (28) and a second support sheet (30). The support sheets (28 & 30) have a high degree of rigidity and can be made from pressed board, mat board, a sheet of plastic, reinforced leather or some other semi-rigid material that provides a firm writing surface, yet flexes slightly to permit insertion of the backing (14) of the notepad (10) into the slot (36) between the rectangular support sheets (28 & 30).

The second support sheet (30) has a height and width no larger than the height and width of the first support sheet (28). The first and second support sheets are located in face-to-face relation and are adhered, preferably by the use of an adhesive, along the common edge (32) of both support sheets. Preferably, an adhesive is applied to an area that extends for a band width (34) along a length of the support sheets. A conventional adhesive may be used such as paper cement and may be applied in a width of about one to about three inches, most preferably about two inches.

The support sheets (28 & 30) define a slot (36) that extends between the support sheets and tapers inwardly as it approaches the edge (32).

Preferably, the first support sheet (28) has a height that is slightly larger than the height of the second support sheet (30) to provide a recess (38) at the top of the notepad holder (12). The recess (38) accommodates the binding (22) of the notepad (10) shown in FIG. 1.

More specifically, as shown particularly well in FIG. 3, the backing (14) is inserted in the slot (36) between the support sheet (28) and the support sheet (30). A frictional force is generated between the supports sheets (28 & 30) and the backing (14) to retain the backing in the slot (36).

As can be appreciated, the support sheets (28 & 30) are made of material that is slightly flexible. More particularly, the support sheets flex slightly to permit insertion of the backing (14) of the notepad (10) into the slot (36) but are sufficiently rigid to provide a firm support and writing surface for the notepad (10). In addition, each support sheet preferably has a thickness of about 0.05 to about 0.25 inches. The combined thickness of both support sheets and the backing provides for a substantially rigid writing surface.

The notepad system is preferably releasably attached to the surface of a refrigerator, visor or any other surface. More specifically, referring to FIG. 3, a surface (38) is shown. A rectangle of hook material (40) is adhered to a surface (38). A rectangle of loop material (42) is adhered to the back of support sheet (28). When the hook and loop material is mated together, the notepad system is releasably attached to surface (38). The hook and loop material can be selected from a variety conventional self-adhesive releasable attachment systems such as VELCRO material. This hook and loop material includes one surface that has an adhesive attached to it so that it will stick to a surface. The adhesive is covered by a release layer that is peeled away, and the backing of the hook material is adhered to a surface such as surface (38).

When the notepad system is used in a car, a piece of hook material is adhered to the surface of the visor located adjacent to the ceiling of the car. The loop material (42) is placed on the back of support sheet (28), and the notepad system can be conveniently attached to the visor of a car. When the notepad is not is use, the visor is simply raised adjacent to the ceiling of the car, and the notepad system is conveniently out of the way. When a person stops along the road, he simply pulls down the visor, removes the notepad system, enters his notes and eventually removes the sheet of writing paper from the notepad. Additional notepads (10) can be kept in the glove compartment of the car or elsewhere and when the writing paper is depleted, the backing (14) of the notepad (10) can be withdrawn from slot (36), and the backing of a full notepad can be inserted into slot (36).

An alternative embodiment is described in FIGS. 4–7. In accordance with this embodiment of the invention, the notepad system includes a rectangular support sheet (50) that is made of a material having a high degree of rigidity, such as pressed board, mat board, a sheet of plastic or other semi-rigid or rigid material that provides a firm writing surface. Rectangular sheets of writing paper (52) are placed in face-to-face relation with the support sheet (50) and are bound by binding (54) to the support sheet (50). The binding (54) can be attached by any conventional matter, including adhesive, stitching, stapling or some other method. The backing sheet (50) is relatively thick, that is, on the order of about 0.05 to about 0.25 of an inch and provides an integral support sheet for the writing paper (52).

Figure 6:
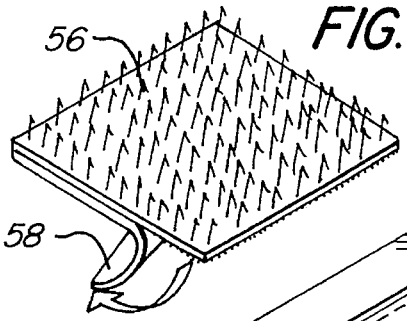
FIGS. 4 through 7 show another embodiment of the invention with FIG. 4 showing a perspective view of a notepad.
Figure 4:
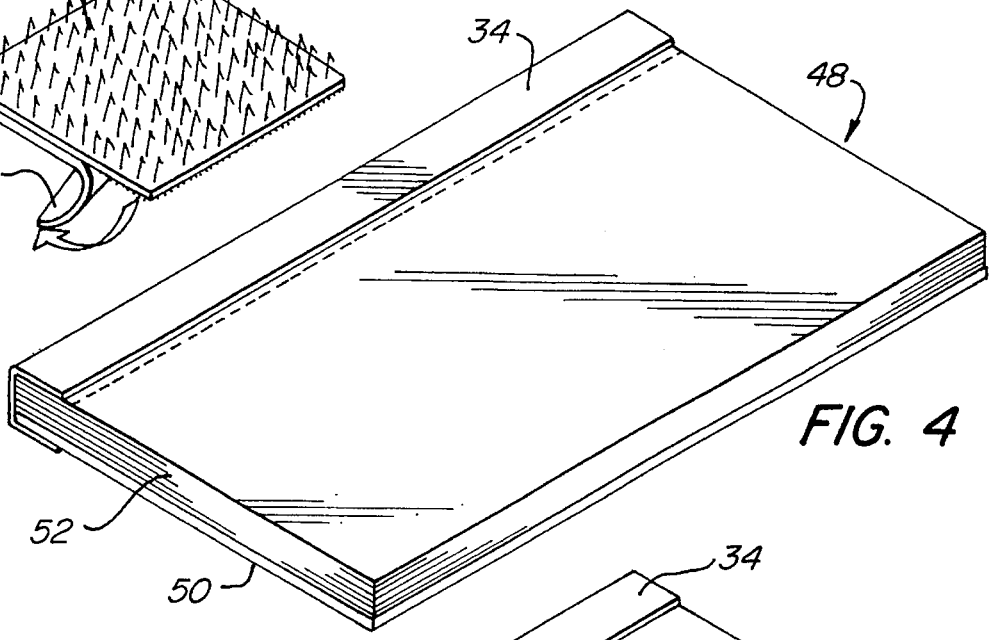
Figure 5:
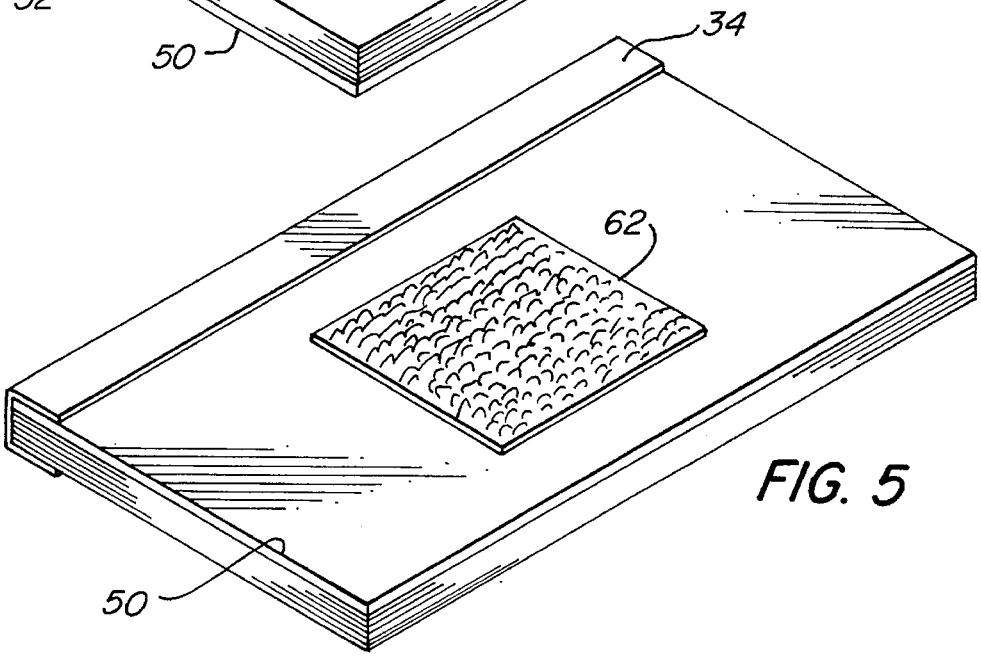
Figure 7:
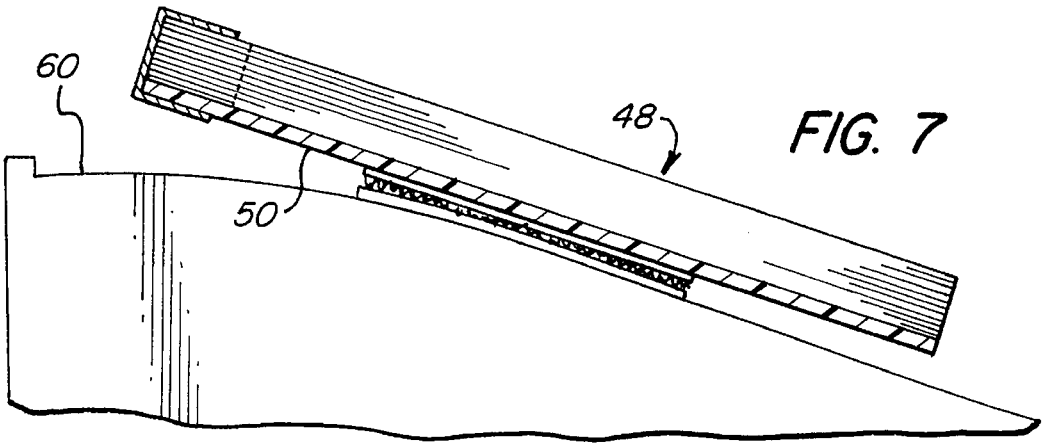

FIG. 6 shows an example of conventional hook material having hooks (56) on one surface thereof and a sheet of release paper (58) adhered to the side of the hook material opposite hooks (56). The release material (58) is removed, and the hook material is placed and adhered to surface (60). A similar sheet of loop material (62) is adhered to backing sheet (50) as shown particularly well in FIG. 7. The notepad system (48) is secured to surface (60) and can be removed from the surface (60) by pulling on the notepad system (48).

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. A note pad system for releasable attachment to a surface, said system comprising:

a notepad comprising a rectangular backing, said backing supporting a plurality of rectangular sheets of writing paper, said backing and said sheets having substantially identical width, said sheets being bound to the backing along an edge of the backing, the paper sheets being in face-to-face relation with the backing and defining a slot between an innermost sheet of paper and the backing;

a notepad holder comprising a first support sheet and a second support sheet, at least one of the support sheets having a high degree of rigidity, said first and second support sheets being located in face-to-face relation and secured along one edge thereof to define a slot between said support sheets;

said backing of said notepad being releasably inserted into said slot between said support sheets, said backing being retained in said slot by friction between the backing and at least one of the support sheets to releasably adhere the notepad to the notepad holder; and said notepad system being adapted to be releasably secured to a surface, said first support sheet having a surface having mounted thereon a material selected from a loop material or a hook material, and wherein the notepad system is provided with a second piece of hook or loop material that releasably engages the first piece, said second piece of material including an adhesive on one side covered by a removable release sheet, said release sheet being removable to expose adhesive for adhering said second piece to said surface.

2. A notepad system according to claim 1 wherein both support sheets are made of a material having a high degree of rigidity.

3. A notepad system according to claim 1 wherein the first support sheet has a height and width and the second support sheet has a height and width no larger than the height and width of the first support sheet.

4. A notepad system according to claim 3 wherein the second support sheet has a height less than the height of the first support sheet to form a recess, said recess receiving a binding of said notepad.

5. A notepad system according to claim 1 wherein said notepad system is adapted to be releasably secured to a surface, said first support sheet having a surface having mounted thereon a material selected from a loop material or a hook material, and wherein the notepad system is provided with a second piece of hook or loop material that releasably engages the first piece, said second piece of material including an adhesive on one side covered by a removable release sheet, said release sheet being removable to expose adhesive for adhering said second piece to said surface.

6. A notepad system according to claim 1 wherein said backing sheet has a height less than the height of the sheets of paper.

7. A notepad system according to claim 1 wherein the height and width of the plurality of rectangular sheets of writing paper is about equal to the height and width of the first support sheet of the notepad holder, said support sheet providing a firm surface for supporting said sheets of writing paper.

8. A notepad system according to claim 1 wherein said slot between said support sheets tapers slightly as it approaches the secured edge, both said support sheets frictionally engaging said backing sheet of said notepad to retain the notepad in an assembled position with respect to the notepad holder.

9. A notepad system according to claim 8 wherein said first and second support sheets are adhered together by an adhesive having a predetermined width applied along substantially the entire width of the notepad holder.

10. A notepad system for mounting on a surface, said system comprising:

a rectangular support sheet having a high degree of rigidity, said support sheet being substantially inflexible and having a thickness between about 0.05 and about 0.25 inches to provide a firm writing surface;

a plurality of rectangular sheets of writing paper being in a face-to-face relation with said support sheet, said support sheet having a width and height that is about the same as the width and height of the rectangular sheets of writing paper, said rectangular sheets of writing paper being bound along one edge of said support sheet; and means for releasably adhering said support sheet to the surface.

11. A notepad system according to claim 10 wherein said means for releasably securing said support sheet to the surface comprises a hook material and a loop material, said hook material being adhered to one of the group consisting of the support sheet and the surface, said loop material being secured to the other of the group consisting of the support sheet and the surface, said hook material capable of engaging said loop material to releasably retain the support sheet to the surface.

12. A note pad system for releasable attachment to a surface, said system comprising:

a notepad comprising a rectangular backing, said backing supporting a plurality of rectangular sheets of writing paper, said backing and said sheets having substantially identical width, said sheets being bound to the backing along an edge of the backing, the paper sheets being in face-to-face relation with the backing and defining a slot between an innermost sheet of paper and the backing;

a notepad holder comprising a first support sheet and a second support sheet, at least one of the support sheets having a high degree of rigidity, said first and second support sheets being located in face-to-face relation and secured along one edge thereof to define a slot between said support sheets;

said backing of said notepad being releasably inserted into said slot between said support sheets, said backing being retained in said slot by friction between the backing and at least one of the support sheets to releasably adhere the notepad to the notepad holder;

said slot between said support sheets tapers slightly as it approaches the secured edge, both said support sheets frictionally engaging said backing sheet of said notepad to retain the notepad in an assembled position with respect to the notepad holder; and said first and second support sheets are adhered together by an adhesive having a predetermined width applied along substantially the entire width of the notepad holder.

* * * * *